US005096119A

United States Patent [19]

Schultheiss et al.

[11] Patent Number: 5,096,119

[45] Date of Patent: Mar. 17, 1992

[54] RAIL FASTENING ON CONCRETE TIES BY MEANS OF RESILIENT TENSION CLAMPS

[75] Inventors: Hans Schultheiss; Horst Bauernfeind, both of Munich; Helmut Eisenberg, Werdohl, all of Fed. Rep. of Germany

[73] Assignee: Vossloh-Werke GmbH, Fed. Rep. of Germany

[21] Appl. No.: 531,598

[22] Filed: Jun. 1, 1990

[30] Foreign Application Priority Data

Jun. 2, 1989 [DE] Fed. Rep. of Germany ..... 3918091

[51] Int. Cl.[5] ..... E01B 9/48

[52] U.S. Cl. ..... 238/349; 238/351

[58] Field of Search ..... 238/310, 315, 338, 340, 238/341, 349, 350, 351

[56] References Cited

U.S. PATENT DOCUMENTS

| | | | |
|---|---|---|---|
| 3,439,874 | 4/1969 | Meier | 238/349 |
| 4,632,307 | 12/1986 | Weber | 238/351 X |
| 4,705,215 | 11/1987 | Eisenberg et al. | 238/338 X |
| 4,770,343 | 9/1988 | Heim et al. | 238/349 |
| 4,802,623 | 2/1989 | Fasterding et al. | 238/351 X |
| 4,907,740 | 3/1990 | Oberweiler et al. | 238/351 X |

FOREIGN PATENT DOCUMENTS

| | | | |
|---|---|---|---|
| 1261151 | 8/1968 | Fed. Rep. of Germany . | |
| 1954008 | 1/1972 | Fed. Rep. of Germany . | |
| 3223305 | 12/1983 | Fed. Rep. of Germany | 238/338 |
| 3306861 | 9/1984 | Fed. Rep. of Germany | 238/338 |
| 3334119 | 7/1985 | Fed. Rep. of Germany . | |
| 3507310 | 9/1986 | Fed. Rep. of Germany | 238/349 |
| 3243895 | 12/1988 | Fed. Rep. of Germany . | |
| 3526653 | 7/1989 | Fed. Rep. of Germany . | |

*Primary Examiner*—Frank E. Werner
*Assistant Examiner*—Craig Slavin
*Attorney, Agent, or Firm*—Sughrue, Mion, Zinn, Macpeak & Seas

[57] ABSTRACT

The invention concerns a rail fastener on concrete ties (4) or the like including resilient tension clamps (6) of steel rods in the form of a W and angled guide plates (3) for the rail base (1*a*). This so-called HM rail fastener is inventively improved by a special shaping of the tension clamp and angled guide plate, to simplify the securing of the rail on the concrete ties, in that the rotation of the elastic strainers which was previously necessary in HM construction when passing from the preassembly to the assembly position is omitted. This is achieved in that the angled guide plate (3), which is provided with a rib (3*a*) extending longitudinally to the rail foot for abutment on the rail foot (1*a*), contains in this rib special recesses (3*b*) for the reception and retention of the free ends of the tension clamp in the preassembly position. A tension clamp (6) has outer legs (6*b*) which with expansion of the spacing from the inner legs (6*d*) against the rail foot (1*a*) become broader and their free ends (6*a*) end outside the middle portion (6*e*) and wherein the inner legs (6*d*) of the tension clamp (6) which surround the tie screw (5) are designed so that in the preassembly position they abut with their center portion (6*e*) the shaft (5*a*) of the tie screw, while the head (5*b*) of the tie screw (5) overlaps the inner leg (6*d*) in the assembly position. In a special embodiment, the tension clamp is so designed that its center portion permanently surrounds the tie screw (5), and its inner leg portions are brought together except for a small spacing.

8 Claims, 7 Drawing Sheets

Figure 3:
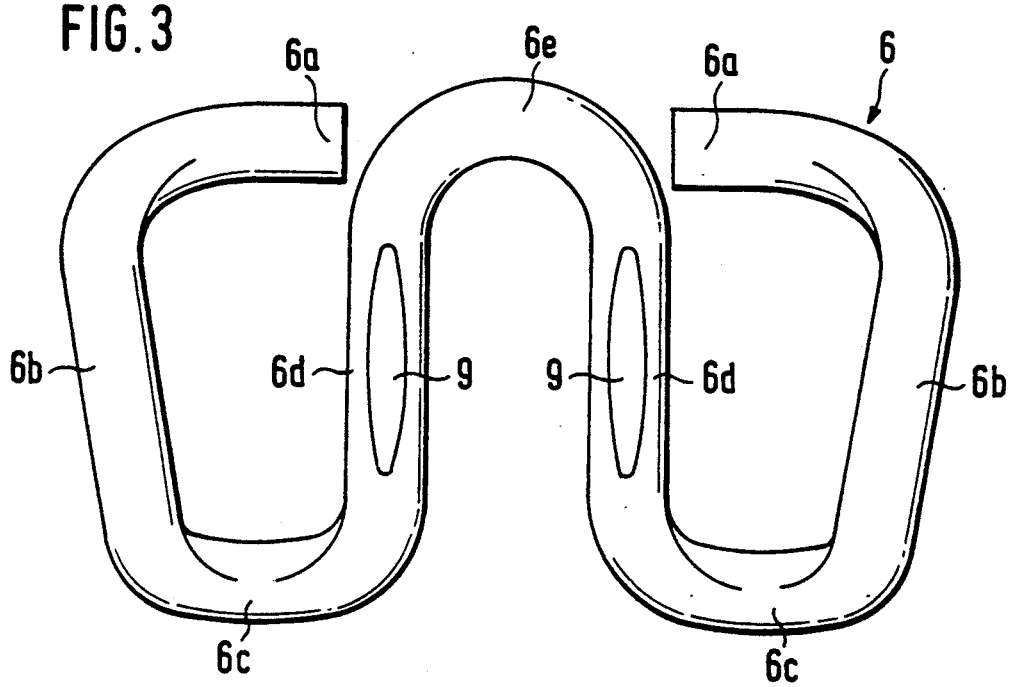

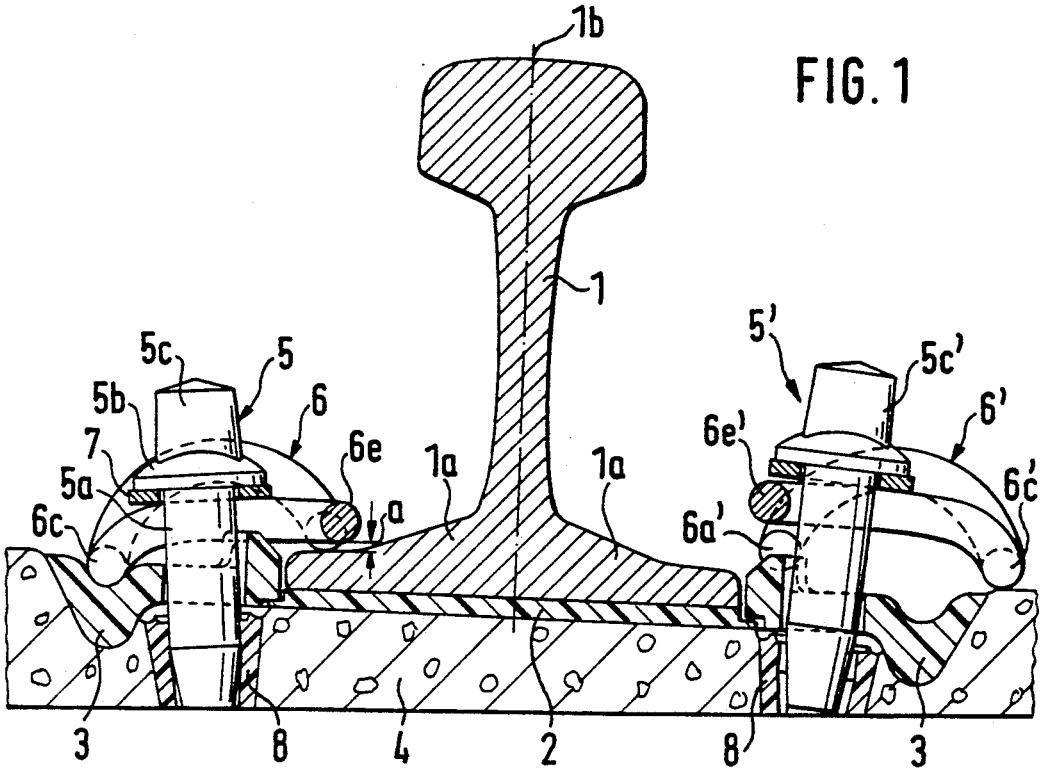
FIG. 1
FIG. 2
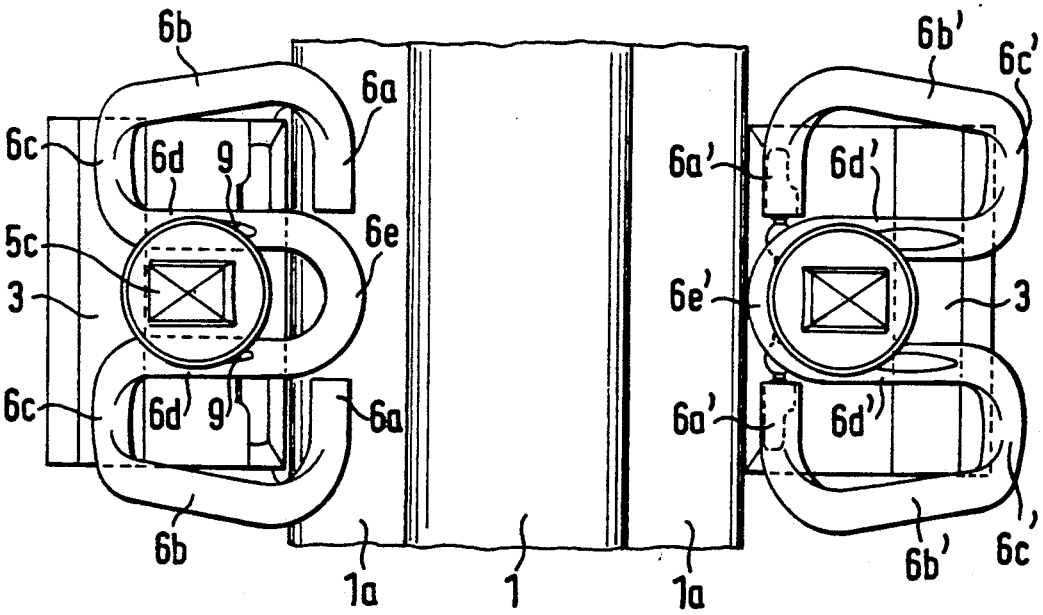

RAIL FASTENING ON CONCRETE TIES BY MEANS OF RESILIENT TENSION CLAMPS

The invention concerns a rail fastener on concrete ties or the like by means of resilient tension clamps made of steel rods. Such a rail fastener, which is also named a HM rail fastener, is described e.g. in DE-PS 12 61 151 (Meier) and in DE-PS 19 54 008 (Münch). The HM fastener has been optimally proven both in Germany and abroad since its introduction. The very simple construction and the firm and lasting adhesion of all the parts cause only low costs for the care of the track and thereby low maintenance costs. Moreover the service life of all the fastening parts has been found to be good, because due to the long-lasting and resilient bracing, on all the fastening parts there is only small wear and tear. The fastening parts are regarded as being the intermediate layer between the rail and the concrete tie, the angled guide plates, the tension clamps, the tie screws as well as the plastic dowels which are inserted in the concrete tie for the tie screws. A suitable angled guide plate for HM rail fastening is described e.g. in DE-OS 32 43 895 of the applicant.

Practically since the beginning of HM fastening for the Deutsche Bundesbahn (cf. e.g. ETR 1968, p. 101) until today, the HM fastening has been performed on concrete ties so that the tension clamps which make possible the preassembly, in which the tension clamps were thus fixed rotated through 180° against their assembly position in the preassembly position necessitated for assembly a loosening of the tie screw and manual rotation of the tension clamp through 180% whereby the free ends arrived in contact with the rail base and the outer arcs facing away from the rail base of the tension clamp arrived in the groove of the upwardly open angled profile. In this position the tension clamp was fixed by the tie screw on the concrete tie.

Whereas in the so-called K-type construction, i.e. when laying the rails on wooden ties, for some time past specially adapted tension clamps had already been suggested, which made possible the preassembly of the ties in a manner such that rotation of the tension clamp out of the preassembly into its assembly position is no longer necessary, no satisfactory solution for preassembly in the HM-type construction has yet been found. As examples of the more recent period for tension clamps which are capable for preassembly in K-type construction, -DE-PS 33 34 119 and 35 26 653 (SKL-12) of the applicant should be named. Evidently because of the special shaping of the angled guide plates in HM construction there were until now difficulties in designing the tension clamp so that it can be transferred from preassembly to finished assembly without rotation through 180°.

It is therefore the object of the invention to improve a rail fastener of the type named above so that the assembly of the HM rail fastener can be carried out without the previously necessary rotation of the tension clamps through 180° when passing from the preassembly to the assembly position. Thus it was possible to save at least two men of the assembly staff and the assembly can be carried out mechanically and correspondingly more cheaply, which is very helpful to the rationalization efforts of all railway enterprises.

The object of the invention is achieved by a rail fastener of the type named above. Further embodiments of the new rail fastener emerge from the sub-claims. The special shaping of the new tension clamp makes it possible, together with the adapted angled guide plate, to achieve simple preassembly as well as a simple transition from the preassembly position to the assembly position after laying the rail on the track. It is only necessary to shift the tension clamp out of its preassembly position into its final position and to tighten the tie screw. Then the arcs of the tension clamp facing away from the rail base slip into the groove of the angled guide plate, whereas the free ends slide out of the corresponding recesses in the rib of the angled guide plate on the rail base.

Figure 4:
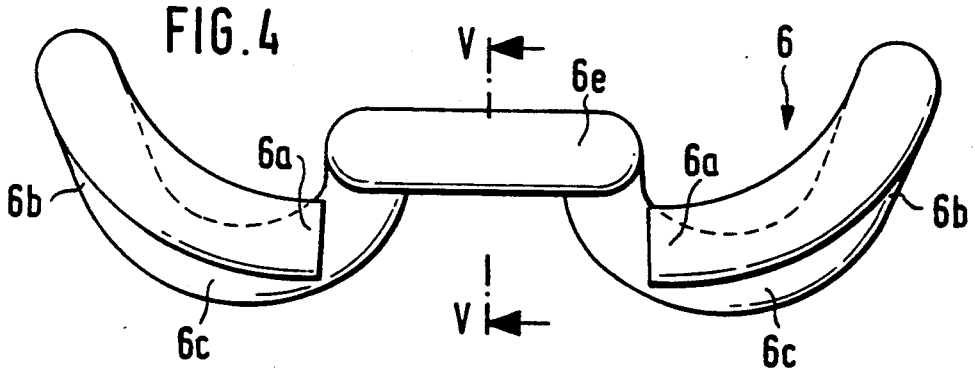
Figure 5:
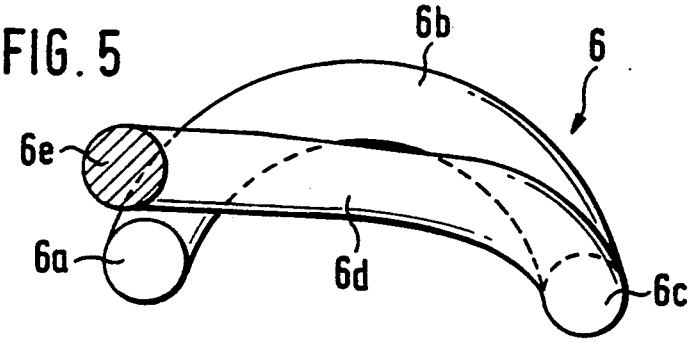
Figure 6:
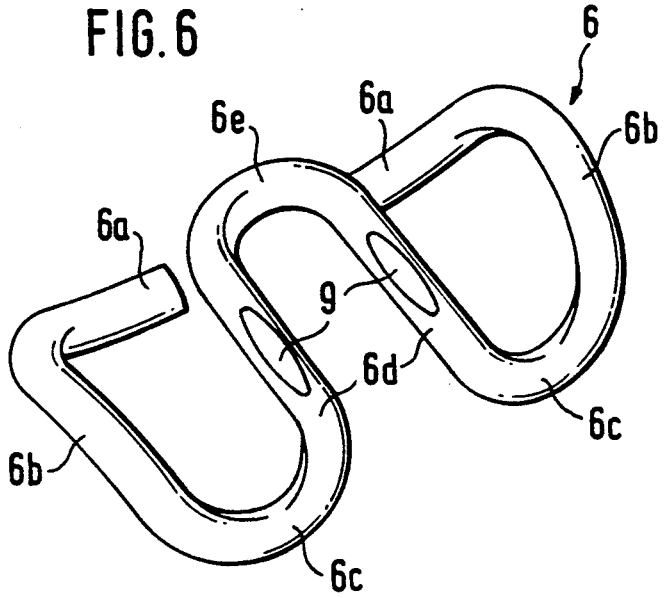
Figure 10:
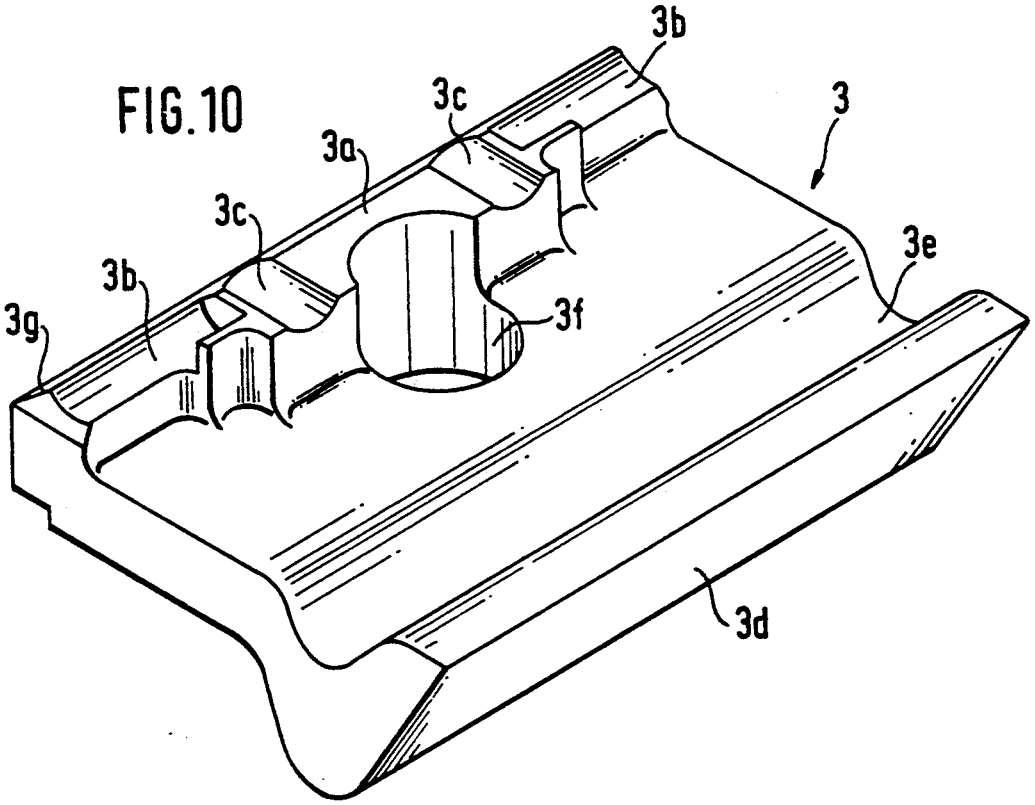
Figure 8:
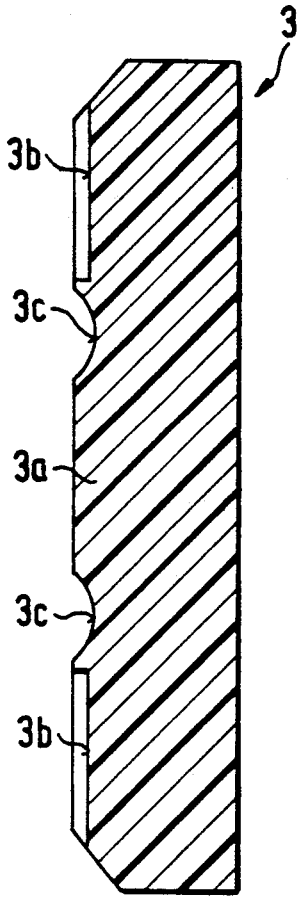
Figure 7:
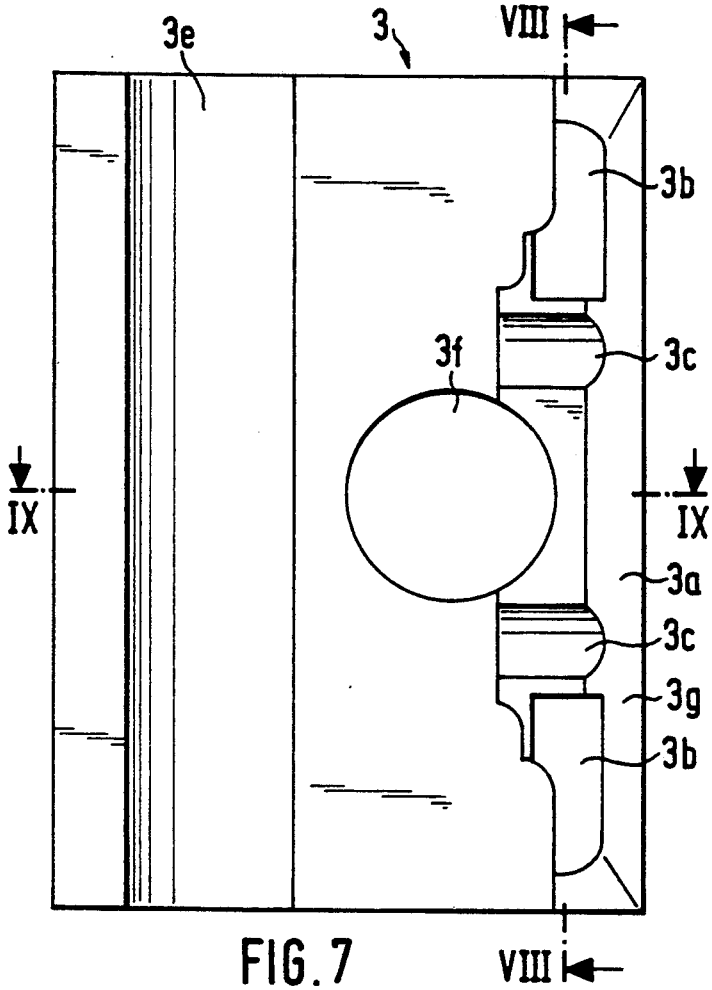
Figure 9:
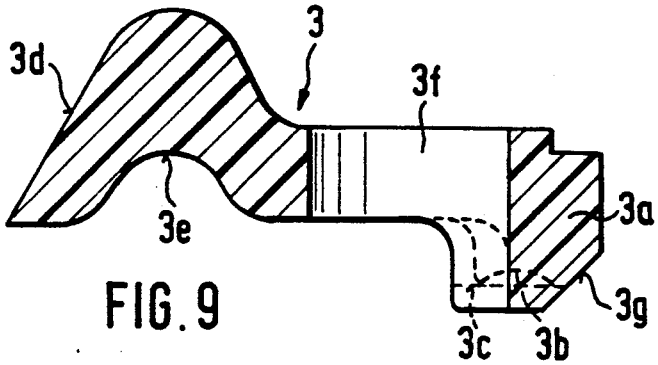
Figure 11:
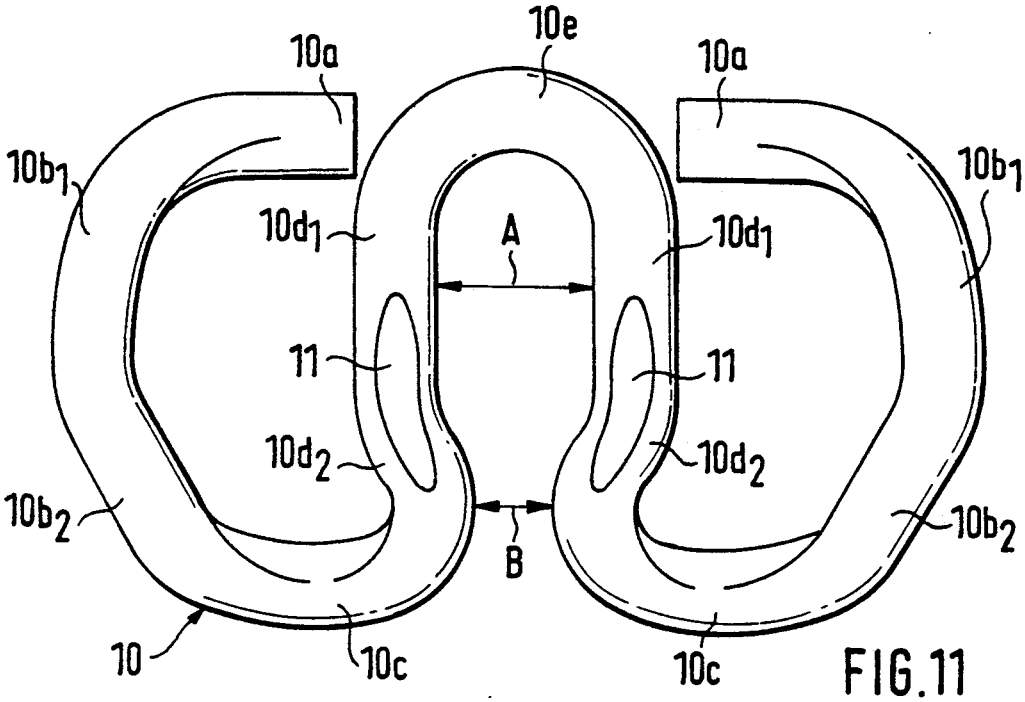
Figure 12:
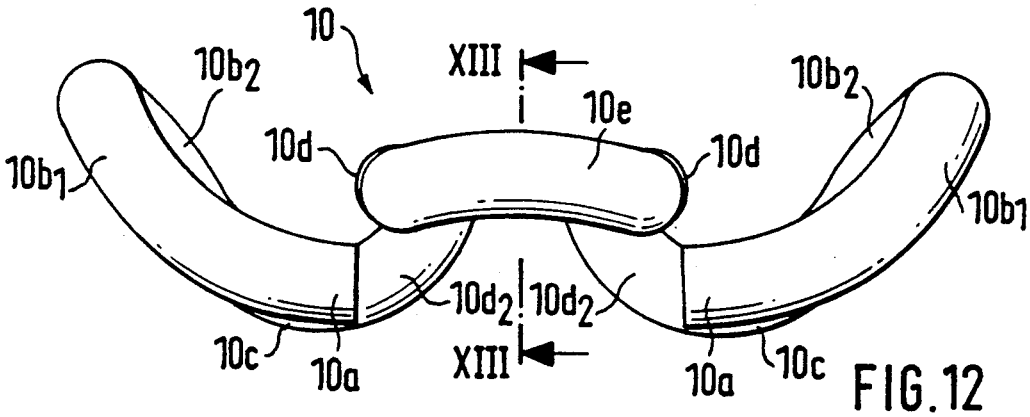
Figure 13:
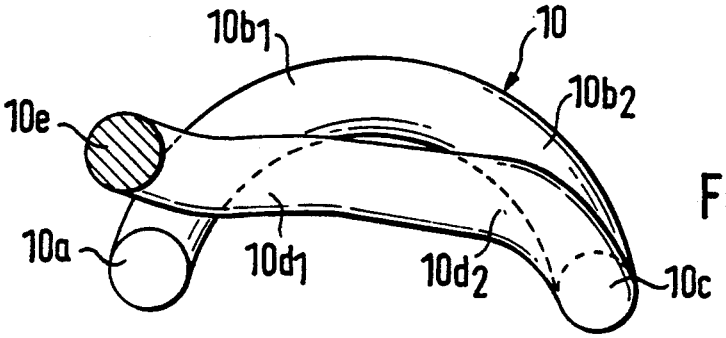
Figure 15:
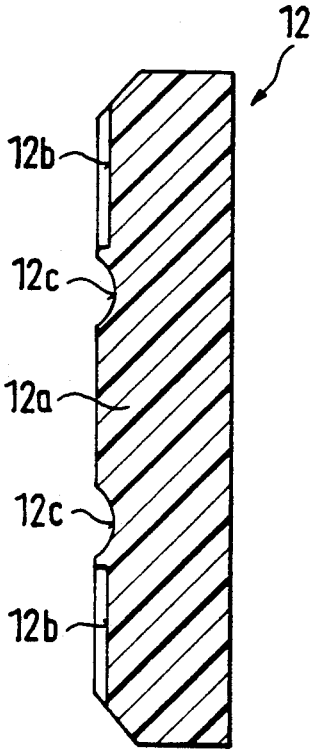
Figure 14:
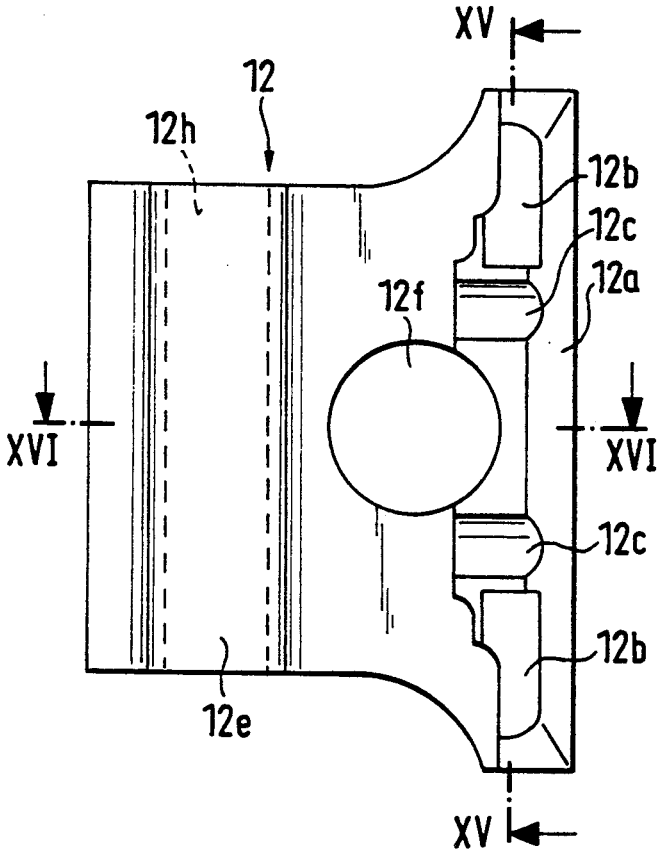
Figure 16:
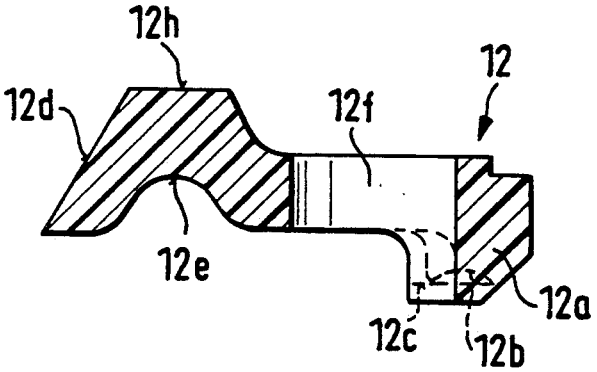
Figure 18:
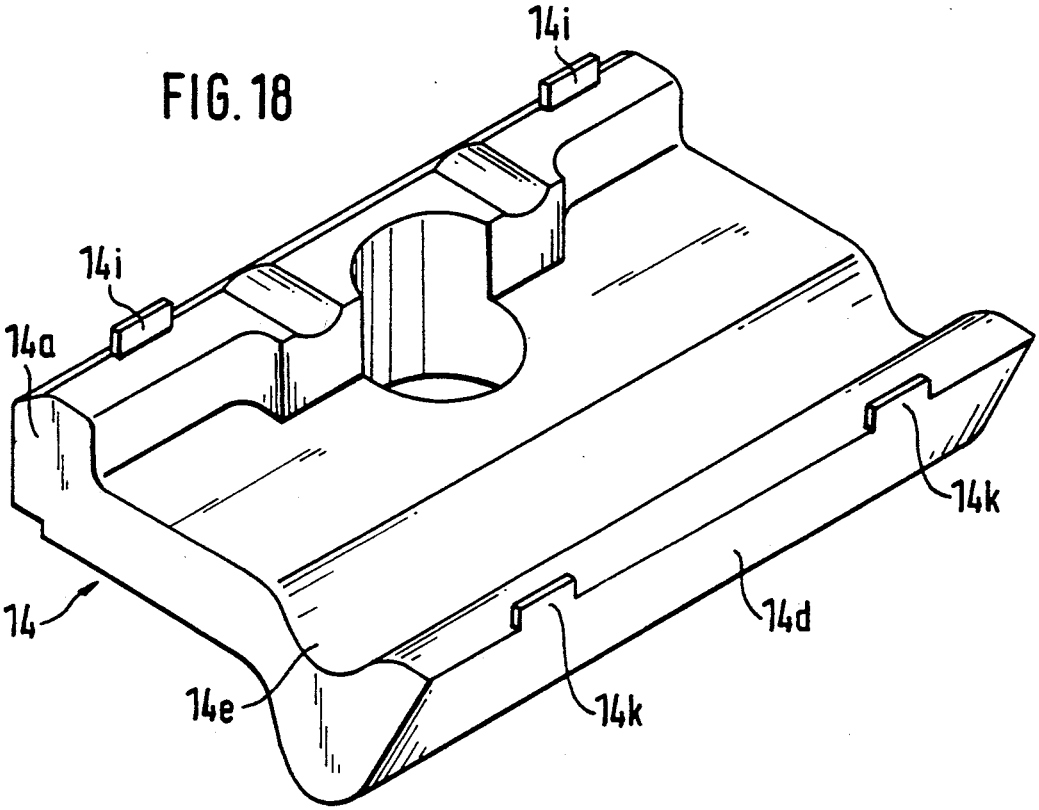
Figure 17:
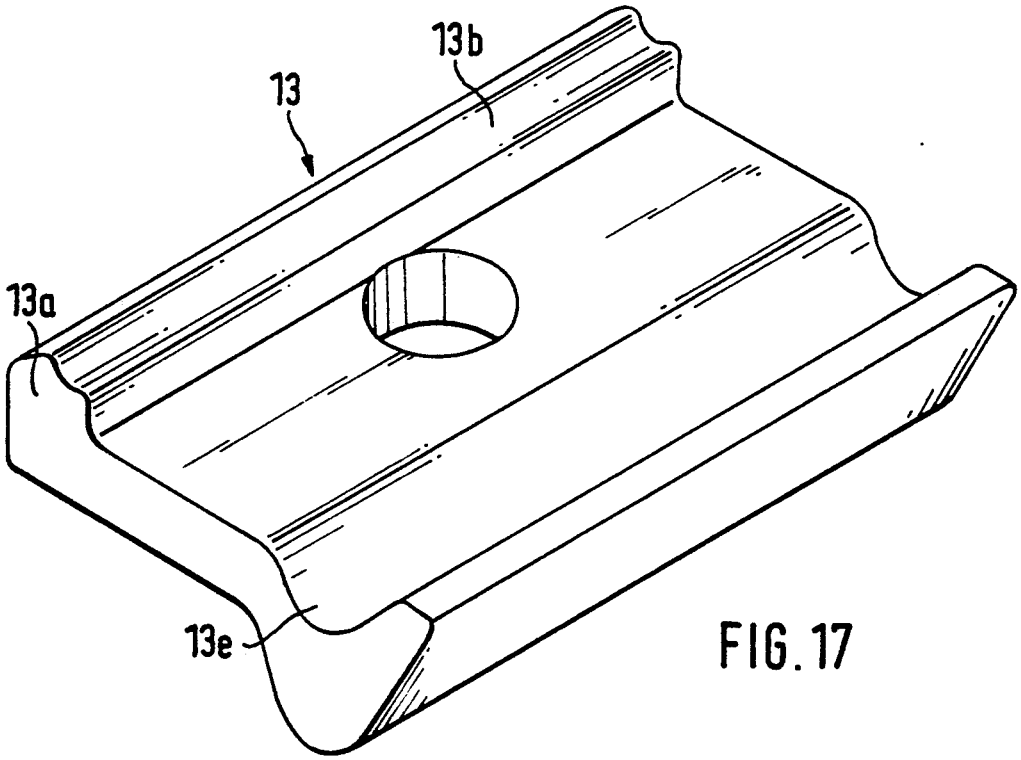

Further details of the invention are to be found in the description of the drawings. The drawings show:

FIG. 1 a cross-section through a rail profile with the new rail fastener according to the invention, in which the left side shows the assembly position in the outer area of the track and the right side shows the preassembly position in the track interior in section, FIG. 2 the plan view of the rail fastener as in FIG. 1, i.e. the left side of FIG. 2 in the assembly position and the right side in the preassembly position, FIG. 3 the plan view of a tension clamp of the inventive rail fastener, FIG. 4 the side view of the tension clamp as in FIG. 3 when viewed from the rail, FIG. 5 the section along the line V—V in FIG. 4, FIG. 6 a perspective view of the tension clamp, FIG. 7 the plan view of an angled guide plate for the new rail fastener, FIG. 8 the section along the line VIII—VIII in FIG. 7, FIG. 9 the section along the line IX—IX in FIG. 7, FIG. 10 a perspective view of an angled guide plate for the new rail fastener, FIG. 11 the plan view of a second embodiment of a tension clamp, which is modified against FIG. 3, FIG. 12 the side view of the tension clamp as in FIG. 11, viewed from the rail, FIG. 13 the section along the line XIII—XIII in FIG. 12, FIG. 14 the plan view of an angled guide plate, modified against FIG. 7, for the tension clamp as in FIG. 11, FIG. 15 the section along the line XV—XV in FIG. 14, FIG. 16 the section along the line XVI—XVI in FIG. 14, FIG. 17 a perspective view of a further angled guide plate for the new rail fastener, FIG. 18 a perspective view of a third angled guide plate for the new rail fastener.

FIGS. 1 and 2 show the inventive rail fastener in the lefthand half respectively in the assembly position and in the righthand half in the preassembly position, FIG. 1 being a center longitudinal section through the concrete tie 4 and FIG. 2 being a plan view, wherein, however, the concrete tie has been omitted and rail 1 has been cut off outside the tension clamps 6, 6'. The lefthand side shows the exterior of the track and the righthand side shows the interior of the track; thus rail 1 is mounted in the exterior of the track and is shown preassembled in the track's interior. To differentiate between the different positions of the assembly elements, all the parts, to the extent that they are in the preassembly position, have been provided with an apostrophy (’), whereas in the assembly position, the pure figures are used.

As can be seen from FIG. 1, the rail 1 which is shown here as an example of the known rail profile UIC 60, rests with an intermediate layer 2 on the concrete tie 4 between the two angled guide plates, wherein the rail axis is inclined into the interior of the track in the manner known per se, in a ratio which is fixed by the respective rail authority, e.g. 1:40. The angled guide plates 3 each have a longitudinal rib 3*a*. The longitudinal ribs 3*a* abut the rail bases la on both sides. The angled guide plates 3 rest in adapted recesses in the concrete tie 4, which extend over the entire width of the tie or a portion thereof.

In the assembly position the free ends 6*a* of tension clamp press on the lefthand rail foot 1*a*, and the center portion 6*e* of tension clamp 6 comes to rest at a minor spacing (a) in the manner known above the rail foot 1*a*. The head 5*b* of the tie screw 5 rests on the bevellings 9 in the region of the inner leg 6*d* of the tension clamp optionally with the intervention of the washer 7. The tie screw 5 is screwed in by means of a torque wrench, which engages on the square head 5*c* of the tie screw 5, in the plastic dowel 8 which is located in the concrete tie 4 in the known manner, until the desired tension and thus the spacing a is produced. In the assembly position, the rear support arcs 6*c* of the tension clamp 6 are supported in the guide groove 3*e* of the angled guide plate 3.

On the righthand side of FIGS. 1 and 2, the preassembly position is shown in section and in plan view. Because of the long shape of the inner leg 6*d* of the tension clamp 6, it is possible simply to displace the tension clamp without rotating it from the preassembly position 6' into the assembly position 6, wherein the free ends 6*a'* slide out of their preassembly position in the recesses 3*b* into the ribs of the angled guide plate 3 over the inclined surfaces 3*g* on the upper edge adjacent to the rail foot of the rib 3*a* onto the rail foot and are displaced on the rail foot 1*a* in the area of the small rise until such time as the rear support arcs 6*c'* come to rest in their positions 6*c* on the base of the guide groove 3*e* of the angled guide plate 3. In the same way one also achieves the transition from the preassembly position into the assembly position when using the modified tension clamp 10 as in FIGS. 11 to 13 and the angled guide plate 12 as in FIGS. 14 to 16. In the case of the modified angled guide plate as in FIG. 18, by the displacement of the tension clamp out of the preassembly position into the assembly position, the plastic stops 14*i*, which hold the tension clamp in its preassembly position can be snapped off or torn off. These projections shown on the rail side in FIG. 18, which serve as stops for the tension clamp, can be provided with a prepared break line to facilitate the snapping off or tearing off in the correct position.

In this position, the tie screw 5' is then tightened up in the manner described above by using a torque wrench and the assembly position 5 shown on the left in FIGS. 1 and 2 is attained.

Whereas previously in the case of HM assembly, the tension clamps SKL-1 had to be rotated through 180° in the transition from the preassembly position, the special shaping of the new tension clamp 6 makes the simplified displacement assembly described above possible. The form of the tension clamp 6 can be seen particularly well in FIGS. 3 to 6. Thus for example, from the plan view as in FIG. 3 one recognizes that the free ends 6*a* of the tension clamp 6 are outside the projection of the strongly extended U-shaped middle portion 6*e* and 6*d*, against the known tension clamps SKL-1. In order to ensure that the new tension clamp, nevertheless, still has the desired soft springing characteristics of the free ends 6*a* of the known omega tension clamps, such as e.g. the known SKL-1 tension clamp as in DE-PS 12 61 151, the outer legs 6*b*, as seen in FIG. 3, are slightly inclined and expand against the inner legs 6*d* in the direction of the rail foot, so that there is sufficient length of the spring steel material of the tension clamp in the free ends 6*a*.

The tension clamp which is shown in FIGS. 3 to 6 interacts in the manner described above with the specially adapted angled guide plate 3 as in FIGS. 7 to 10. The angled guide plate 3, apart from the known internal guide grooves 3*c* for the inner legs 6*d* of the tension clamp 6, as is also described in DE-PS 32 43 895, has special outer recesses 3*b* for the free ends 6*a* of the tension clamp 6' in the preassembly position. In this position, the free ends 6*a'*, as can be seen on the right-hand side in FIG. 2, rest in these special recesses 3*b*, whose form is adapted to that of the free ends 6*a'*, whereas the rear support arcs 6*c'* rest outside the angled guide plate 3 on the surface of the concrete tie 4. The transition from the preassembly to the assembly position is performed by simple displacement of the tension clamp orthogonally to the axis of the rail 1 in the direction of the rail, wherein the rear support arcs 6*c'* slide into the position 6*c* on the base of the guide groove 3*c* of the angled guide plate, whereas the free ends 6*a'* arrive in the position 6*a* on the rail foot and are secured there in the manner described above. As stated already, the stops 14*k* which are provided in the embodiment of FIG. 18 on the angled guide plate 14 are snapped off or torn off.

FIGS. 11, 12 and 13 show a somewhat modified variant of a tension clamp 10, which is also suitable for carrying out the inventive displacement assembly in a simple manner, without rotation of the tension clamps on the concrete ties. As one can easily see when comparing the tension clamp 10 of FIG. 11 with the tension clamp 6 as in FIG. 3, i.e. when comparing the plan views of the tension clamps, the U-shaped central zone of the tension clamp, which consists of the center portion 10*e* and the two inner legs 10*d*, has been modified against the variant described above so that this zone is not U-shaped, but the two U-legs $10d_1$ approach each other in the transition area to the rear support arcs 10*c*, i.e. in the sections $10d_2$, until the spacing B is reached. This spacing B is less than the spacing A in the area of the parallel inner leg $10d_1$, in which area the shaft 5*a* of the tie screw 5 is located. This ensures that the tension clamp 10' in the preassembly position is held undetachably on the concrete tie even when, the tie screw 5 is not tightened. This shape, moreover, ensures that the tension clamp 10, during displacement from its preassembly position 10' into the assembly position 10, cannot leave the zone of constriction for the tie screw 5, and thus it comes to rest securely with its rear supporting arcs 10*c* in the guide groove (3*e*, 12*e*, 13*e* or 14*e*) of the angled guide plate which is used. The flattened portions 11 follow the form of the inner leg portions $10d_1$ and $10d_2$ and serve as the support for the head 5*d* of the tie screw with the washer 7.The tension clamp 10 is positioned exactly in the preassembly position, i.e. it rests securely in the reception aperture 12*b* or in the reception groove 13*b*, or in the recesses adjacent to the stops 14*i* of the angled guide plates 12, 13 or 14.

As can be seen further from FIG. 11, because of the insertion of the profile of the tension clamp in the regions $10d_2$ as far as a minimal spacing B there is simultaneously an approximation of the rear support arcs 10*c*, so that the support points of these arcs come more closely together in the guide groove 3*e* of the angled guide plate 3. The initial consequence for the tension clamp is a somewhat different shaping in the zone of the outer leg, namely a sub-division into sections $10b_1$ adjacent to the free ends 10*a* of the outer leg and in the sections adjacent to the rear support arcs 10*c* of the outer leg $10b_2$, as can easily be seen from the plan view in FIG. 11.

On the other hand, this shaping also makes possible a modification of the angled guide plate, as shown in FIGS. 14 to 16. The coming together of the support points in the rear support arc 10*c* means in fact that the angled guide plate 12 which is altered against angled guide plate 3 can be substantially shortened in the area of its guide groove 12*e*, whereby material can be saved in the desired manner, without the function and strength, i.e. reliability, of the angled guide plate 12 being adversely affected against the larger angled guide plate 3. In addition, material can also be saved in the area opposite the groove, as is discernible from the cross-section shown in FIG. 16. In its totality, this means a material saving of about 30% for the embodiment of angled guide plate 12 against angled guide plate 3, granted the same basic dimensions.

If one compares FIG. 12 with FIG. 4, it is found that apart from the difference already described in the shaping of the legs 10*b* and 10*d* of the tension clamp 10, the central portion 10*e* is also differently designed against central portion 6*e*, in that the foremost zone of the center portion 10*e*, i.e. the zone which most closely abuts the rail 1, is somewhat higher than the remaining zone of the central arc. This is also discernible from the center section of FIG. 13. This variant in fact has nothing to do with the variant described just above with the shorter angled guide plate; it can be used in the same way as for the embodiment as in FIGS. 3 to 6 and it is advantageous when, as is usual for certain foreign rail authorities, rail profiles are used in which the rail foot rises more steeply, e.g. in the ratio of 1:4, which corresponds to the gradient of 14% against a gradient of only 4% in the UIC-60 profile which was used as the example. The curvature of the central arc 10*e*, which is shown in FIGS. 12 and 13, ensures that even in the event of a stronger gradient of the rail foot 1*a*, the condition is maintained that the center portion of the tension clamps rests in the assembled state at a slight spacing a above the rail foot.

We claim:

1. A rail fastener that can be preassembled on concrete ties (4) for fastening a rail having a foot, said fastener being arranged on both sides of the rail, comprising:

a resilient tension clamp (6; 10) made of a steel rod having an epsilon shape, said tension clamp including inner legs (6*d*, $10d_1$), outer legs (6*b*), a central portion (6*e*, 10*e*), free ends (6*a*', 10*a*'), and rear support portion (6*c*, 10*c*), said outer legs (6*b*, 10*b*) extending toward said rail foot (1*a*) and the free ends (6*a*',10*a*') being directed towards one another and being disposed outside of the inner legs (6*d*, $10d_1$);

an angled guide plate (3; 12; 14) having one side adapted to abut against a foot of said rail and another side, opposite said one side, which has an inclined surface (3*d*; 12*d*, 14*d*) which is adapted to be disposed in a recess provided in said concrete tie (4), said plate further including retaining means disposed in said one side for retaining said free ends (6*a*', 10*a*') when in a preassembled position, a center groove 3*e*; 12*e*; 14*e*) disposed in said other side of said plate and a longitudinal rib (3*a*, 12*a*, 14*a*) having a pair of guide grooves (3*c*, 12*c*, 14*c*), said rib abutting on said rail foot (1*a*);

a tie screw having a shaft (5) for securing said tension clamp and said guide plate in a preassembled and an assembled position, said tie screw being anchored in said tie;

wherein in a preassembled position said free ends (6*a*'; 10*a*') are engaged in said retaining means of said plate and said center portion (6*e*, 10*e*) of said tension clamp abuts against the shaft of said tie screw; and wherein in an assembled position, said clamp is urged in the direction of said tie by tightening said tie screw such that said rear support portions (6*c*, 10*c*) of said clamp are retained in said center groove (3*e*; 12*e*; 14*e*) of said plate, said inner legs (6*d*, $10d_1$) are engaged by said guide grooves (3*d*, 12*c*, 14*c*), said inner legs (6*d*; $10d_1$) surround said shaft of said tie screw and are overlapped by the head of said screw, and said central portion (6*e*; 10*e*) of said tension clamp is lightly displaced above said rail foot (1*a*) a predetermined distance (a).

2. A rail fastener as in claim 1, wherein the inner legs ($10d_1$) of the tension clamp (10) approach each other shortly before the transition in the rear support portion (10*c*) so as to surround the tie screw (5) in the zone of the inner leg portions ($10d_2$) except for a small spacing (B).

3. A rail fastener as in claim 1 wherein said retaining means comprises trough-shaped recess (3*b*; 12*b*) for receiving and retaining said free ends.

4. A rail fastener of claim 1 wherein said retaining means comprises removable plastic stops (14*i*) extending from said plate for retaining said free ends.

5. A rail fastener as in claim 1, wherein the length of the inclined support surface (12*d*) and the center groove (12*e*) of the angled plate (12) is shorter than the longitudinal rib (12*a*) of said plate (12).

6. A rail fastener as in claim 4, wherein the removable plastic stops (14*i*) of the angled guide plate (14) ar arranged on the upper side of opposite end portions of the longitudinal rib (3*a*; 12*a*; 14*a*) extending parallel to the rail foot (1*a*).

7. A rail fastener as in claim 1, further comprising removable plastic stops (14*k*) projecting from the inclined surface (14*d*) of the angled guide plate (14), said stops projecting above the concrete ties in the final assembly, to fix the tension clamp (6, 10) in the preassembly portion.

8. A rail fastener as in claim 1, wherein the central portion (10*e*) of the tension clamp (10) is curved convexly in its apex in relation to the plane of the adjacent inner legs (10*d*).

* * * * *